US011530891B2

(12) United States Patent
Quinn et al.

(10) Patent No.: US 11,530,891 B2
(45) Date of Patent: Dec. 20, 2022

(54) REVERSE BAFFLE COMPENSATOR

(71) Applicant: Cobalt Kinetics, Washington, UT (US)

(72) Inventors: Timothy Aaron Quinn, St George, UT (US); Clifford J. Frederickson, St George, UT (US)

(73) Assignee: Cobalt Kinetics, Washington, UT (US)

( * ) Notice: Subject to any disclaimer, the term of this patent is extended or adjusted under 35 U.S.C. 154(b) by 0 days.

(21) Appl. No.: 17/494,801

(22) Filed: Oct. 5, 2021

(65) Prior Publication Data

US 2022/0107153 A1 Apr. 7, 2022

Related U.S. Application Data

(60) Provisional application No. 63/087,798, filed on Oct. 5, 2020.

(51) Int. Cl.
*F41A 21/36* (2006.01)

(52) U.S. Cl.
CPC ..... *F41A 21/36* (2013.01)

(58) Field of Classification Search
CPC ..... F41A 21/36
USPC ..... 89/14.3
See application file for complete search history.

(56) References Cited

U.S. PATENT DOCUMENTS 1,247,528 A 11/1917 Hammond
1,533,966 A 4/1925 Browning
2,899,866 A * 8/1959 Clark et al. ..... F41A 21/32 89/14.3
4,128,042 A 12/1978 Atchisson
4,545,285 A 10/1985 McLain
4,664,015 A 5/1987 Kennedy
5,303,677 A 4/1994 Kleinguenther et al.
5,519,954 A 5/1996 Garrett
6,070,352 A 6/2000 Daigle
6,752,062 B2 6/2004 Vais
6,820,530 B2 11/2004 Vais
(Continued)

OTHER PUBLICATIONS

Notification of Transmittal of the International Search Report and the Written Opinion of the International Searching Authority, or the Declaration; International Application No. PCT/US2017/013887, WIPH, LLC (Lake, David AT.); dated Sep. 13, 2017.
(Continued)

*Primary Examiner* — Samir Abdosh
(74) *Attorney, Agent, or Firm* — Maschoff Brennan

(57) ABSTRACT

A firearm attachment may include a threaded adapter, and the threaded adapter may include a first threaded portion and a second threaded portion. The second threaded portion may include an inner threaded portion and an outer threaded portion. The firearm attachment may include a housing that may be configured to couple to the outer threaded portion. The firearm adapter may include a reverse baffle compensator that may be configured to couple to the inner threaded portion. The reverse baffle component may include a first baffle portion and a second baffle portion, and a channel may be disposed between a first narrow end of the first baffle portion and a second narrow end of the second baffle portion. The reverse baffle portion may include one or more holes on a sloped portion of the first baffle portion and one or more holes on a sloped portion of the second baffle portion.

20 Claims, 12 Drawing Sheets

(56) References Cited

U.S. PATENT DOCUMENTS

| | | | | |
|---|---|---|---|---|
| 6,907,814 | B2 | 6/2005 | Spinner et al. | |
| 7,032,339 | B1 | 4/2006 | Bounds | |
| 7,047,864 | B2 | 5/2006 | Spinner et al. | |
| 7,143,680 | B2 | 12/2006 | Bender | |
| 7,219,462 | B2 | 5/2007 | Finn | |
| D594,082 | S | 6/2009 | O'Quinn | |
| 7,661,219 | B1 | 2/2010 | Knight, Jr. et al. | |
| D616,521 | S | 5/2010 | Starnes | |
| 7,798,045 | B1 | 9/2010 | Fitzpatrick et al. | |
| 7,849,777 | B1 | 12/2010 | Zadrosser | |
| 8,087,337 | B1 | 1/2012 | Cary | |
| 8,156,854 | B2 | 4/2012 | Brown | |
| 8,161,861 | B2 | 4/2012 | Haley et al. | |
| 8,261,652 | B2 | 9/2012 | Findlay | |
| 8,327,749 | B2 | 12/2012 | Underwood | |
| 8,359,966 | B1 | 1/2013 | Brotherton | |
| 8,387,296 | B2 | 3/2013 | Overstreet et al. | |
| 8,479,635 | B2 | 7/2013 | Overstreet et al. | |
| 8,505,680 | B2 | 8/2013 | Dueck | |
| 8,561,517 | B2 | 10/2013 | Brown | |
| 8,567,556 | B2 | 10/2013 | Dueck | |
| 8,572,875 | B2 | 11/2013 | Sisgold | |
| 8,713,832 | B2 | 5/2014 | Troy | |
| 8,826,797 | B2 | 9/2014 | Overstreet et al. | |
| D719,234 | S | 12/2014 | Hochstrate | |
| D720,421 | S | 12/2014 | Chen | |
| 8,904,691 | B1 | 12/2014 | Kincel | |
| 8,984,786 | B2 | 3/2015 | Underwood | |
| D735,288 | S | 7/2015 | Gomez | |
| D736,336 | S | 8/2015 | Mayberry | |
| 9,097,474 | B1 | 8/2015 | Zins et al. | |
| D745,622 | S | 12/2015 | Zusman | |
| D745,627 | S | 12/2015 | Kielsmeier | |
| D773,585 | S | 1/2016 | Miller, III | |
| D748,754 | S | 2/2016 | Chastain | |
| D752,171 | S | 3/2016 | Chen | |
| 9,310,152 | B1 | 4/2016 | Poling | |
| D755,329 | S | 5/2016 | Kielsmeier | |
| 9,482,478 | B2 | 11/2016 | Newman | |
| D746,936 | S | 12/2016 | Huang | |
| D773,592 | S | 12/2016 | Jones | |
| 9,541,339 | B2 | 1/2017 | Orne, III | |
| 9,557,125 | B2 | 1/2017 | Stewart et al. | |
| D779,018 | S | 2/2017 | Zayatz | |
| 9,599,419 | B2 | 3/2017 | McGinty | |
| D795,379 | S | 8/2017 | Frederickson et al. | |
| D795,984 | S | 8/2017 | Frederickson et al. | |
| D795,985 | S | 8/2017 | Frederickson et al. | |
| D795,986 | S | 8/2017 | Frederickson et al. | |
| D807,980 | S | 1/2018 | Frederickson et al. | |
| 10,054,384 | B1 * | 8/2018 | Marfione | F41A 21/30 |
| 10,113,819 | B2 | 10/2018 | Stewart et al. | |
| 10,228,201 | B2 | 3/2019 | Walther et al. | |
| 10,612,878 | B1 * | 4/2020 | Salvador | F41A 21/325 |
| 10,852,091 | B1 * | 12/2020 | Helms | F41A 21/30 |
| 11,397,066 | B1 * | 7/2022 | Oglesby | F41A 21/325 |
| 11,408,702 | B2 * | 8/2022 | Reis-Green | F41A 21/325 |
| 2005/0000138 | A1 | 1/2005 | Kiss | |
| 2005/0183310 | A1 | 8/2005 | Finn | |
| 2007/0006720 | A1 | 1/2007 | Liao | |
| 2010/0269387 | A1 | 10/2010 | Drajan | |
| 2010/0275485 | A1 | 11/2010 | Findlay | |
| 2010/0319231 | A1 | 12/2010 | Stone | |
| 2011/0056107 | A1 | 3/2011 | Underwood | |
| 2011/0226121 | A1 | 9/2011 | Peterson et al. | |
| 2011/0247483 | A1 | 10/2011 | Overstreet | |
| 2011/0252957 | A1 | 10/2011 | Overstreet et al. | |
| 2012/0167424 | A1 | 7/2012 | Gomez | |
| 2012/0174451 | A1 | 7/2012 | Overstreet et al. | |
| 2012/0180354 | A1 | 7/2012 | Sullivan | |
| 2012/0246987 | A1 | 10/2012 | Anthony | |
| 2012/0297656 | A1 | 11/2012 | Langevin | |
| 2013/0014416 | A1 | 1/2013 | Sisgold | |
| 2013/0152442 | A1 | 6/2013 | Underwood | |
| 2014/0060310 | A1 | 3/2014 | Overstreet et al. | |
| 2014/0130390 | A1 | 5/2014 | Geissele | |
| 2014/0150639 | A1 | 6/2014 | Sugg | |
| 2014/0331535 | A1 | 11/2014 | Robinson | |
| 2015/0101230 | A1 | 4/2015 | Curtis | |
| 2015/0153125 | A1 | 6/2015 | Lutton | |
| 2015/0198400 | A1 | 7/2015 | O'Dell | |
| 2015/0323271 | A1 | 11/2015 | McGinty | |
| 2015/0362270 | A1 | 12/2015 | Stewart et al. | |
| 2016/0153742 | A1 | 6/2016 | Copeland | |
| 2017/0082385 | A1 | 3/2017 | Orne, III | |
| 2017/0160026 | A1 | 6/2017 | Walther | |
| 2017/0191770 | A1 | 7/2017 | Stewart et al. | |
| 2018/0106569 | A1 * | 4/2018 | Smith | F41A 21/30 |
| 2020/0224989 | A1 * | 7/2020 | Bundy | F41A 21/325 |
| 2022/0107153 | A1 * | 4/2022 | Quinn | F41A 21/36 |

OTHER PUBLICATIONS

Notification of Transmittal of the International Search Report and the Written Opinion of the International Searching Authority, or the Declaration; International Patent Application No. PCT/US2016/064964, WIPH, LLC (Walther, Michael H., et al); dated Feb. 24, 2017.

Notification and Transmittal of the International Search Report and the Written Opinion of the International Searching Authority, or the Declaration, PCT/US2015/035669, Wilson Precision Arms, Inc. (Stewart, Skylar J, et al), dated Sep. 14, 2015.

* cited by examiner

REVERSE BAFFLE COMPENSATOR

CROSS-REFERENCE TO RELATED APPLICATIONS

The present application claims priority to and the benefit of U.S. Provisional Patent Application Ser. No. 63/087,798, entitled REVERSE BAFFLE COMPENSATOR, which was filed on Oct. 5, 2020, and is hereby incorporated by reference in its entirety.

BACKGROUND

The present disclosure is generally directed to a firearm compensator and, in particular, to a reverse baffle compensator.

Firearms, such as pistols or rifles, expel large amounts of pressurized gas in the process of firing projectiles. As a projectile exits the muzzle, a "muzzle blast" is created from the explosive shockwave of the pressurized gas exiting the muzzle. The muzzle blast often results in both a very loud sound and a high energy compression wave. The sound, sometimes called a "muzzle report," can exceed 140 decibels and may cause significant hearing loss to the user of the firearm, or those nearby. The compression wave may create unwanted motion in the firearm, including muzzle rise, linear movement, recoil, etc. Various products and firearm designs are directed at counteracting the effects muzzle blast.

The subject matter claimed in the present disclosure is not limited to embodiments that solve any disadvantages or that operate only in environments such as those described above. Rather, this background is only provided to illustrate one example technology area where some embodiments described in the present disclosure may be practiced.

SUMMARY

Many firearms include a barrel, such as a rifle barrel. Many rifle barrels allow devices to be attached to the barrel, such as a muzzle device. A muzzle device may be a muzzle brake, compensator, flash suppressor, and the like. A muzzle brake may direct gasses and muzzle blast of a fired projectile away from the shooter. A muzzle brake may reduce recoil from the firearm, which may increase accuracy and/or increase rate of fire. A compensator may divert or direct gasses and/or muzzle blast in a desired direction, which may help keep the firearm from rising during a firing sequence. A compensator may also help keep the muzzle or barrel in a more stable position. For example, a compensator may be used to counter the upward movement of the barrel, which may be referred to as muzzle flip. A linear compensator may direct sound and gasses away from the shooter. A linear compressor may not suppress sound, but the redirection of sound may reduce the noise or decibel level for the shooter, which may make for a more pleasant shooting experience.

One aspect is a compensator, such as a reverse baffle compensator, that may be attached to a firearm. In some embodiments, the reverse baffle compensator may include a threaded adapter. In some embodiments, the threaded adapter may include a first threaded end and a first threaded portion. The threaded adapter may include a second threaded end and the second threaded end may be positioned opposite the first threaded end. The second threaded end may include a second threaded portion. In some embodiments, the second threaded portion may include an inner threaded portion and an outer threaded portion.

Another aspect is a compensator, such as a reverse baffle compensator, that may include a housing. In some embodiments, the housing may be configured to be coupled to the outer threaded portion of the threaded adapter.

Still another aspect is a compensator, such as a reverse baffle compensator, that may include a reverse baffle component. In some embodiments, the reverse baffle component may be configured to be coupled to the inner threaded portion of the threaded adapter. In some embodiments, the reverse baffle component may include a first baffle portion and a second baffle portion.

In some embodiments, the first baffle portion may include a first wide end with a first wide diameter. The reverse baffle component may also include a first narrow end with a first narrow diameter. The first narrow end may be part of the first baffle portion and/or the second baffle portion. The first narrow end may be positioned opposite the first wide end, and the first wide diameter may be greater than the first narrow diameter. The reverse baffle component may further include a first sloped portion connecting and/or disposed between the first wide end and the first narrow end.

In some embodiments, the second baffle portion may include a second wide end with a second wide diameter. The reverse baffle component may also include a second narrow end with a second narrow diameter. The second narrow end may be part of the first baffle portion and/or the second baffle portion. The second narrow end may be positioned opposite the second wide end, and the second wide diameter may be greater than the second narrow diameter. The reverse baffle component may further include a second sloped portion connecting and/or disposed between the second wide end and the second narrow end. In these and other embodiments, the reverse baffle component may include a channel that may connect and/or be disposed between the first narrow end and the second narrow end.

A further aspect is a compensator, such as a reverse baffle component, that may include multiple chambers, such as a first chamber and a second chamber. In some embodiments, the first chamber may be at least partially formed by an interior space of the first baffle portion. In some embodiments, the second chamber may be at least partially formed by an interior space of the second baffle portion.

Another further aspect is a compensator, such as a reverse baffle compensator, that may include a first baffle portion and a second baffle portion. The first baffle portion and the second baffle portion may be generally aligned along the same axis, and the first baffle portion and the second baffle portion may be disposed in opposing directions. For example, the first baffle portion may be disposed with the first wide end in a first direction and the second baffle portion may be disposed with the second wide end in a second direction, and the second direction may be opposite the first direction. After reviewing this disclosure, one of ordinary skill in the art will appreciate that the first and second baffle portions may have other suitable shapes, sizes, configurations, and/or arrangements. For example, the first and second baffle portions may have tapered configurations and may have a larger opening on one side and a smaller opening on an opposing side. While the first and second baffle portions may have a generally or substantially conical configuration, it will be appreciated that the first and second baffle portions may have other suitable shapes, sizes, configurations, and arrangements, depending, for example, upon the intended use of the compensator.

Still another further aspect is a compensator, such as a reverser baffle compensator, that may include a first set of one or more holes or apertures, and the first set of holes may be disposed on the first sloped portion of the first baffle portion. In some embodiments, the reverse baffle compensator may include a second set of one or more holes or apertures, and the second set of holes may be disposed on the second sloped portion of the second baffle portion. In these and other embodiments, the first set of holes and/or the second set of holes may be configured to connect one or more chambers, such as the first chamber and the second chamber. One or more holes of the first set of holes may be aligned with one or more holes of the second set of holes. For instance, one or more holes of the first set of holes may be at least partially aligned with one or more holes of the second set of holes. After reviewing this disclosure, one or ordinary skill in the art will appreciate that the alignment and/or arrangement of one or more holes of the first set of holes and/or one or more holes of the second set of holes may impact and help control airflow, gun blast, sound, and the like. While the baffle portions may have a generally conical configuration, the baffle portions may include other surfaces or structures, such as sidewalls, conical rings, and the like. In addition, the baffle portions may include other aspects or features, such as the second wide end of the second baffle portion may include one or more cut-outs, openings, and the like. For instance, the second wide end of the second baffle portion may include multiple cut-outs and the cut-outs may have a generally semicircular configuration.

These and other aspects, features and advantages may become more fully apparent from the following brief description of the drawings, the drawings, the detailed description of preferred embodiments and appended claims.

The objects and advantages of the example embodiments may be realized and achieved at least by the elements, features, and combinations particularly pointed out in the claims.

Both the foregoing general description and the following detailed description are given as examples and are explanatory and are not restrictive of the invention, as claimed.

BRIEF DESCRIPTION OF THE DRAWINGS

The appended drawings contain figures of example embodiments to further illustrate and clarify the above and other aspects, advantages and features of the present invention. It will be appreciated that these drawings depict only example embodiments of the invention and are not intended to limit its scope. Additionally, it will be appreciated that while the drawings may illustrate preferred sizes, scales, relationships and configurations of the invention, the drawings are not intended to limit the scope of the claimed invention. Example embodiments will be described and explained with additional specificity and detail through the use of the accompanying drawings in which:

DESCRIPTION OF EXAMPLE EMBODIMENTS

The present invention is generally directed towards a compensator for a firearm. The principles of the present invention, however, are not limited to firearm compensators. It will be understood that, in light of the present disclosure, the compensators disclosed herein can be successfully used in connection with other types of structures and devices.

Additionally, to assist in the description of the compensator, words such as top, bottom, front, rear, right, and left are used to describe the accompanying figures. It will be appreciated, however, that the present invention can be located in a variety of desired positions, including various angles, sideways and even upside down.

The example compensator may be referred to as a reverse baffle compensator because, for example, the compensator may include one or more baffles. The baffles may be disposed in a reverse or opposing configuration. A detailed description of an example compensator now follows.

Shooting a firearm often results in a significant amount of muzzle movement, including muzzle rise and lateral movements. In additional, there may be significant recoil as a consequence of discharging the firearm, which may depend on the caliber of the firearm and other factors. Various forms of compensation may be applied to the firearm including muzzle breaks, suppressors, and compensators. Muzzle breaks may be primarily directed at limiting recoil, especially in high caliber firearms, but may lead to large increases in sound for the shooter and bystanders, because gases are redirected backwards to offset the recoil. Suppressors may be generally directed to reducing the amount of sound emitted from the firing of a firearm. Suppressors may be difficult to obtain because they are often regulated by the Bureau of Alcohol, Tobacco, and Firearms. Compensators may act similarly to muzzle breaks but may be directed towards stabilizing the muzzle. This may be achieved, for example, by directing gases laterally and/or vertically from the muzzle. Compensators may have similar drawbacks as sound levels can be damaging to bystanders and the shooter.

In some circumstances, example embodiments of the compensator may reduce muzzle rise and/or reduce lateral muzzle movement. In addition, some embodiments of the compensator may reduce the amount of traumatic sound for the shooter and bystanders by redirecting the expulsion of gas (and subsequently, the muzzle blast) forward and away from both shooter and bystanders.

Figure 1A:
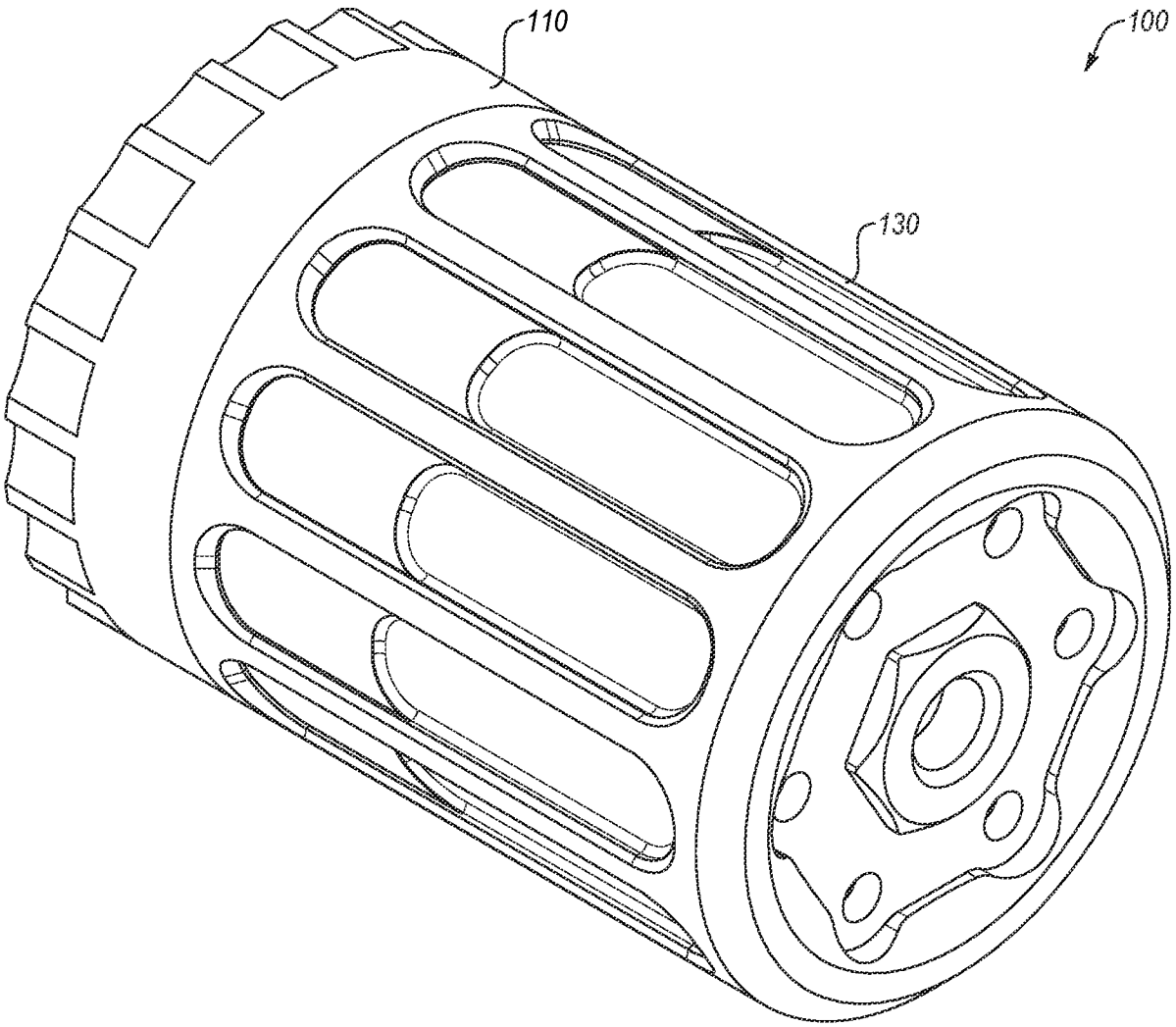
FIG. 1A is a perspective view of an example reverse baffle compensator.

FIG. 1A illustrates a perspective view of an example reverse baffle compensator 100, in accordance with at least one embodiment described in the present disclosure. The reverse baffle compensator 100 may include a threaded adapter 110, a reverse baffle component 120 (not pictured in FIGS. 1A and 1B), and a housing 130. As shown in the accompanying figures, the threaded adapter 110 may include one or more connecting components, such as threaded portions, that may facilitate attachment of the reverse baffle compensator to a firearm and/or the assembly of the reverse baffle compensator 100.

In some embodiments, the threaded adapter 110 may be configured to attach to a firearm. For example, the exterior of the threaded adapter 110 may include one or more features, such as tactile components, configured to facilitate a user's handling of the threaded adapter 110, such as attaching and/or detaching the threaded adapter 110 to or from a firearm. For example, the threaded adapter 110 may include a pattern of ridges and/or grooves, which may provide a user increased grip. In another example, the outer surface of the threaded adapter 110 may be textured, roughened, cross-hatched, and/or stippled to provide better handling for the user. In some embodiments, the threaded adapter 110 may be constructed of a material suitable for use with a firearm. For example, the threaded adapter 110 may be made of steel, copper, aluminum, etc. In these and other embodiments, the threaded adapter 110 may include a finish that may aid in preserving the threaded adapter 110. For example, the threaded adapter 110 may be treated with phosphate finish, a nitride finish, or another finish suitable for use with a firearm. In some embodiments, the threaded adapter 110 may be configured to couple to the reverse baffle component 120 and/or the housing 130.

In some embodiments, the housing 130 may be configured to couple to the threaded adapter 110. Specifics related to the attachment of the housing 130 to the threaded adapter 110 may be discussed in connection with additional figures, such as FIGS. 2A, 2B, and 3. The housing 130 may include one or more features or tactile components configured to facilitate the user's handling of the housing 130, such as attaching and/or detaching the housing 130 to or from the threaded adapter 110. The features or tactile components on the housing 130 may be the same, or substantially similar to the features or tactile components on the threaded adapter 110. For example, the housing 130 may include a pattern of ridges and/or grooves, a textured, roughened, or coarse surface, cross-hatching, and/or stippling that may provide a user increased grip. Alternatively, or additionally, the exterior of the housing 130 may include an ornamental design. The ornamental design may change the aesthetics or appearance of the housing 130, and the ornamental design may be intended to match an ornamental design of a firearm.

In some embodiments, the housing 130 may be comprised of a similar material as the threaded adapter 110. For example, the housing 130 may be made of steel, copper, aluminum, etc. Alternatively, or additionally, the housing 130 may be comprised of a material different than the threaded adapter 110. In some embodiments, the housing 130 may be made of a homogenous material. Alternatively, or additionally, the housing 130 may include more than one type of material. For example, in instances in which the exterior of the housing 130 is an ornamental design, the materials forming the ornamental design may differ from the materials forming the remainder of the housing 130.

Figure 2A:
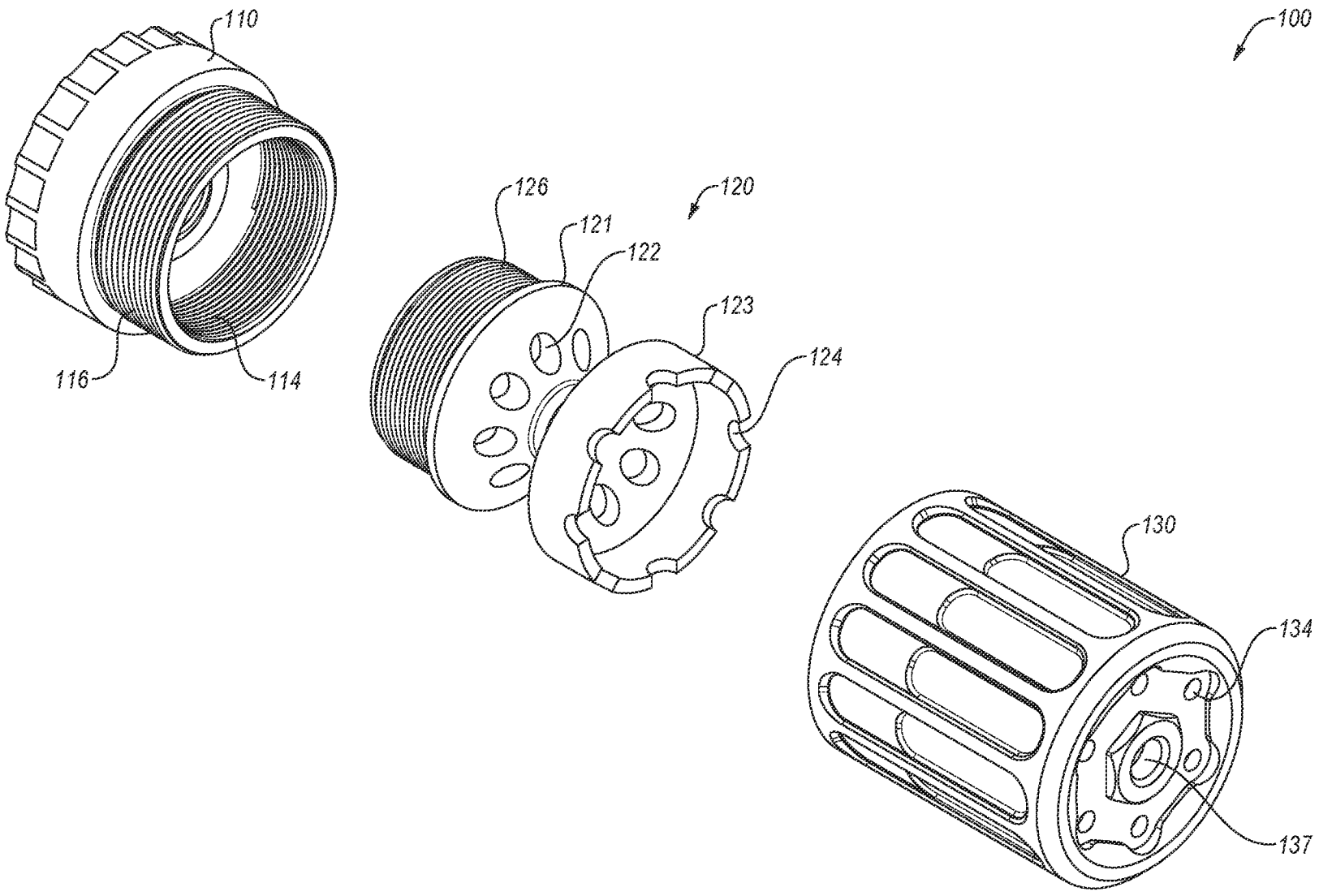
FIG. 2A is an exploded, perspective view of an example reverse baffle compensator.

In some embodiments, the housing 130 may include one or more holes or apertures, such as the holes 134 as shown in FIG. 2A. For example, a distal end of the housing 130 may be disposed opposite the end configured to couple to the threaded adapter 110, and the distal end may include one or more holes or apertures. The one or more holes or apertures in the housing 130 may include a central hole, and the central hole may be part of a housing central channel, such as the housing central channel 137 shown in FIG. 2A. The housing central channel 137 may be sized and configured to allow a projectile from a firearm to pass through. In some embodiments, the housing central channel 137 may be surrounded by the holes 134, and the holes 134 may vary in size from the housing central channel 137. For example, the holes 134 may include a diameter that may be smaller than the diameter of the housing central channel 137. In some embodiments, the holes 134 may be arranged symmetrically around the housing central channel 137. For example, the housing 130 may include six holes 134 and the holes 134 may be equally spaced in a circular pattern around the housing central channel 137. Alternatively, or additionally, the housing 130 may include more or less holes 134 than the six described and illustrated in FIG. 2A. In some embodiments, with the exception of the holes 134 and/or the housing central channel 137 as discussed, the housing 130 may be nonporous. In these and other embodiments, the housing 130 may allow or force expelled gases from the firearm out the holes or apertures, such as the holes 134 and/or the housing central channel 137, disposed in the distal end of the housing 130.

Figure 9:
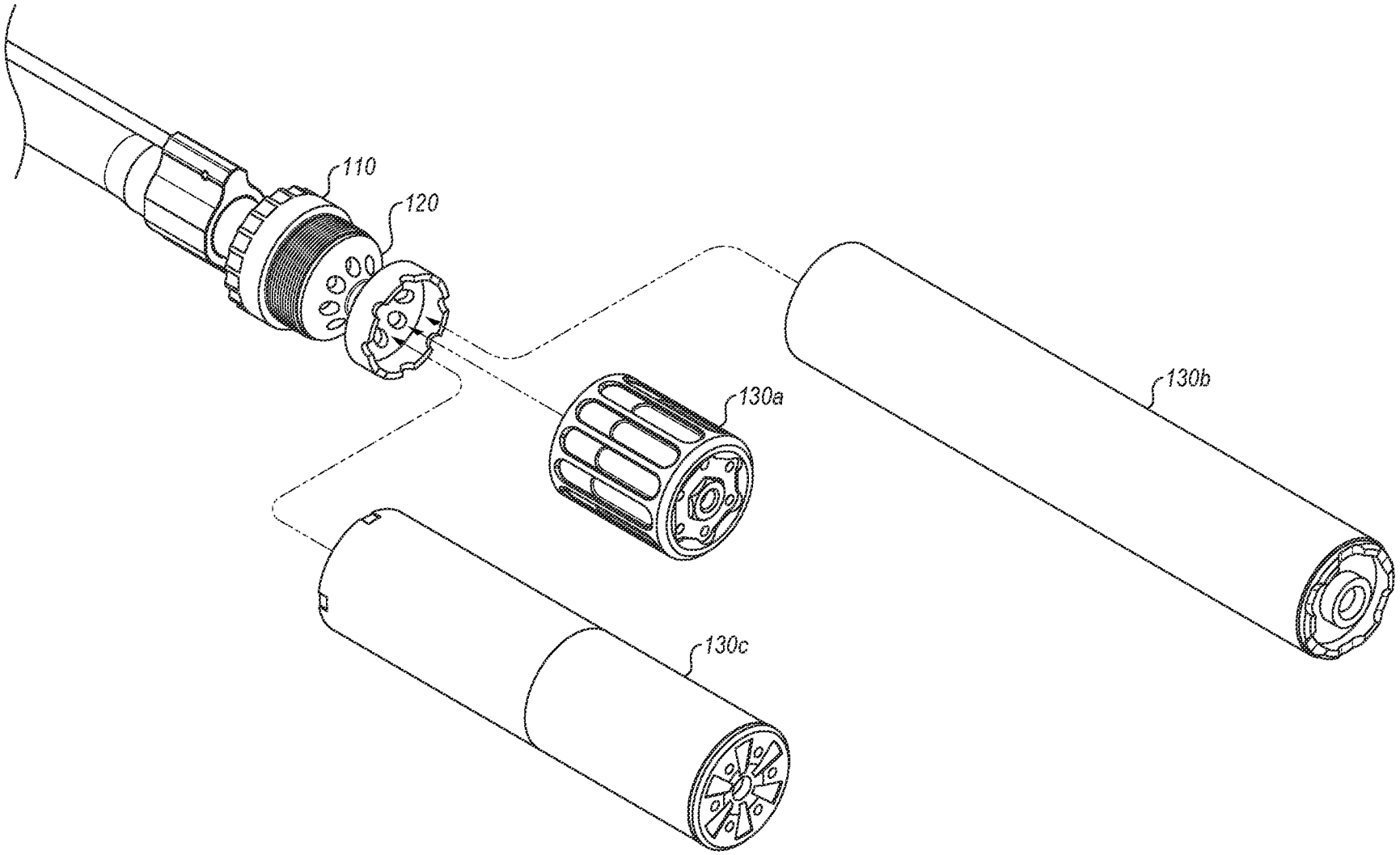
FIG. 9 is an exploded, perspective view of an example reverse baffle compensator, illustrating three example housings that may be used with the reverse baffle compensator.

In some embodiments, the reverse baffle compensator 100 may be between about two and about four inches in length. For example, a distance from the end of the threaded adapter 110 to the end of the housing 130 may be about two and a half inches in length. Alternatively, or additionally, the length of the reverse baffle compensator 100 may vary based on the size of the housing 130. For example, FIG. 9 illustrates different exemplary sizes of housings 130 that may be used with the reverse baffle compensator 100, and the housing 130 may vary in length. In some embodiments, the reverse baffle compensator 100 may be between about one and about three inches in diameter. For example, the cross-sectional width of the reverse baffle compensator 100 may be about one and a half inches. In some embodiments, the diameter of the threaded adapter 110 may be about the same diameter of the housing 130. Alternatively, or additionally, the diameter of the housing 130 may be larger and/or smaller than the diameter of the threaded adapter 110.

Figure 1B:
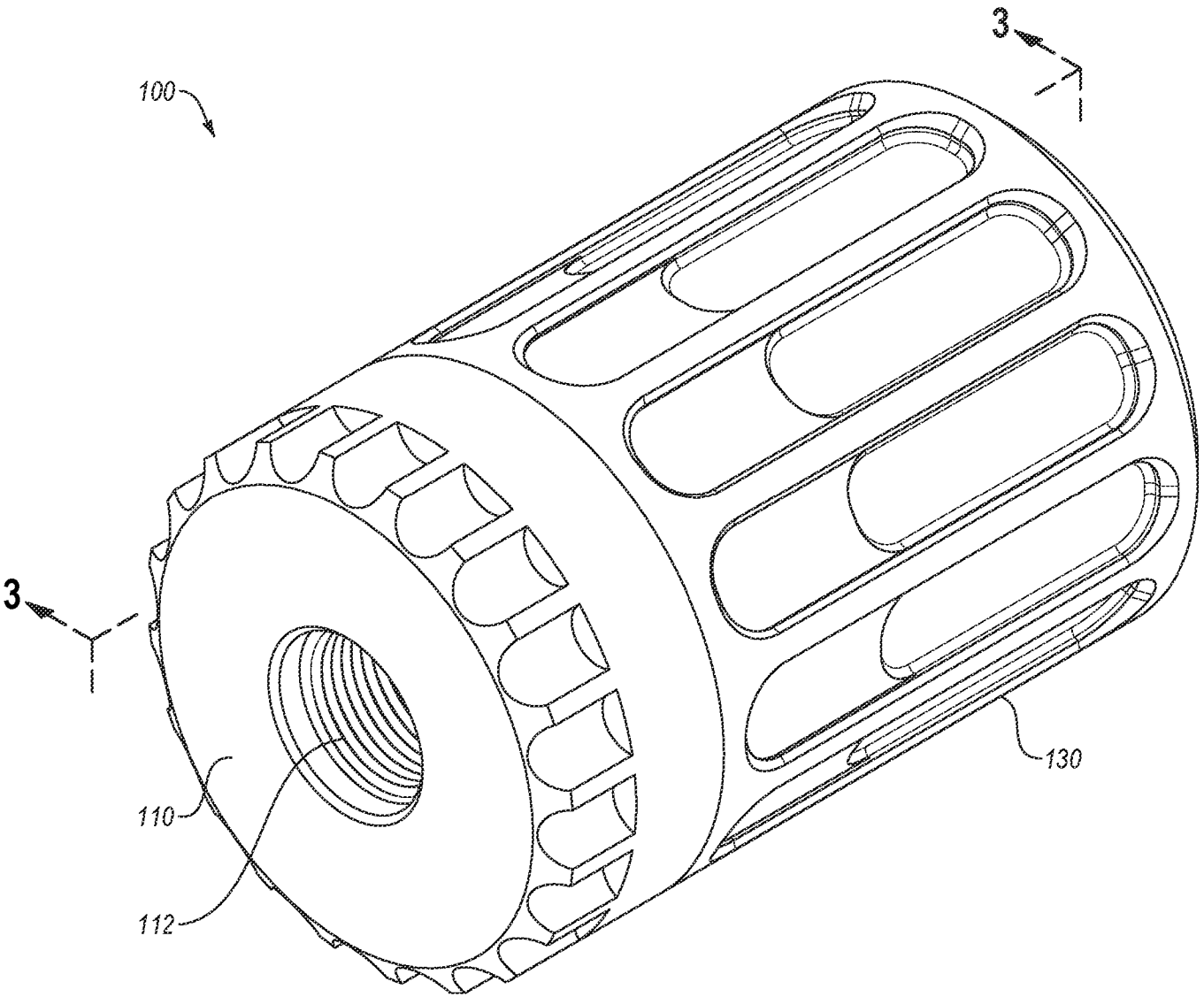
FIG. 1B is another perspective view of an example reverse baffle compensator.

FIG. 1B illustrates a perspective view of the reverse baffle compensator 100. In particular, FIG. 1B illustrates a barrel threaded portion 112 of the threaded adapter 110. In some embodiments, the barrel threaded portion 112 may be configured to attach to the end of a barrel of a firearm. The barrel threaded portion 112 may be sized to fit various caliber barrels on a variety of firearms. For example, the barrel threaded portion 112 may be configured to attach to a barrel that is sized for a 9 mm projectile. In another example, the barrel threaded portion 112 may be configured to attach to a barrel that is sized for a 5.56 mm projectile. In these and other embodiments, the examples are not meant to be limiting, but rather illustrate the variety of barrels to which the barrel threaded portion 112 may be configured to attach. Advantageously, the threaded adapter 110 may be sized and configured to allow the reverse baffle compensator 100 to be attached to different firearms, different types and/or sizes of barrels, and the like. In addition, different threaded adapters 110 may be used with the reverse baffle compensator 100.

Further, different sizes of threaded adapters 110 may be interchangeable, which may increase the versatility and flexibility of the reverse baffle compensator 100.

Figure 2B:
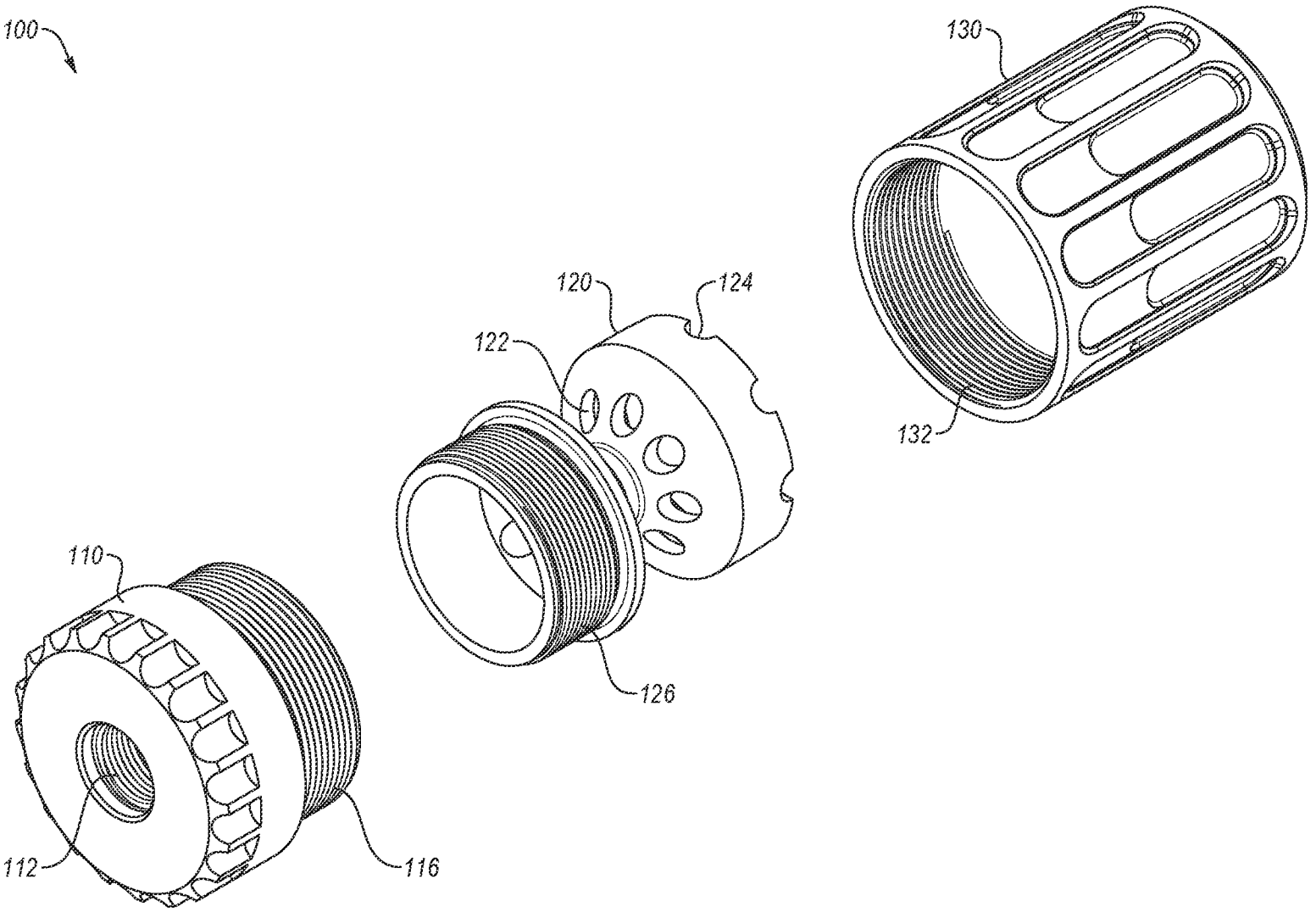
FIG. 2B is another exploded, perspective view of an example reverse baffle compensator.

FIGS. 2A and 2B illustrate exploded, perspective views of the reverse baffle compensator 100. The reverse baffle compensator 100 may include the threaded adapter 110, the reverse baffle component 120, and the housing 130. The threaded adapter 110 may include the barrel threaded portion 112, an inner threaded portion 114, and an outer threaded portion 116. The reverse baffle component 120 may include a first baffle portion 121, and the first baffle portion 121 may include one or more baffles holes, such as a first baffle hole 122*a*, a second baffle hole 122*b*, a third baffle hole 122*c*, etc., which may be referred to collectively as the baffle holes 122. The reverse baffle component 120 may include a second baffle portion 123, and the second baffle portion 123 may include one or more openings or cutouts, such as a first semicircular hole 124*a*, a second semicircular hole 124*b*, a third semicircular hole 124*c*, etc., which may be referred to collectively as the semicircular holes 124. The reverse baffle component 120 may include a baffle threaded portion 126. The housing 130 may include a housing threaded portion 132, and the housing 130 may include one or more holes or openings, such as a first hole 134*a*, a second hole 134*b*, a third hole 134*c*, etc., which may be referred to collectively as the holes 134. After reviewing this disclosure, one of ordinary skill in the art will appreciate that the reverse baffle compensator 100 may include any suitable number and combination of features, components, and/or aspects, and that some or all of these features, components, and/or aspects may not be required.

In some embodiments, the threaded adapter 110 may be configured to attach to a barrel of a firearm. For example, the threaded adapter 110 may be similar to the threaded adapter 110 of FIGS. 1A and 1B. The threaded adapter 110 may include a barrel threaded portion 112, which may be similar to the barrel threaded portion 112 of FIG. 1B.

The threaded adapter 110 may include an inner threaded portion 114. The inner threaded portion 114 may be configured to couple the threaded adapter 110 and the reverse baffle component 120. For example, the inner threaded portion 114 may be configured to receive the baffle threaded portion 126 of the reverse baffle component 120. The inner threaded portion 114 may include a lubricant that may enable a smoother attachment and/or detachment with the reverse baffle component 120. Alternatively, or additionally, the inner threaded portion 114 may include a sealant such that the connection between the threaded adapter 110 and the reverse baffle component 120 is sealed, such as hermetically sealed.

The threaded adapter 110 may include an outer threaded portion 116. The outer threaded portion 116 may be configured to couple the threaded adapter 110 and the housing 130. For example, the outer threaded portion 116 may be configured to engage the housing threaded portion 132 of the housing 130. The outer threaded portion 116 may include a lubricant that may enable a smoother attachment and/or detachment with the housing 130. Alternatively, or additionally, the outer threaded portion 116 may include a sealant such that the connection between the threaded adapter 110 and the housing 130 is sealed, such as hermetically sealed. In some embodiments, the outer threaded portion 116 may be sized to be attached to other housings aside from housing 130.

In some embodiments, the reverse baffle component 120 may be comprised of a material that is substantially the same as the threaded adapter 110 and/or the housing 130. The reverse baffle component 120 material may include steel, copper, aluminum, or any other suitable material for use with a firearm. Alternatively, or additionally, the reverse baffle component 120 may be comprised of a different material than the threaded adapter 110 and/or the housing 130. In some embodiments, the reverse baffle component 120 may include a finish that may aid in preserving the reverse baffle component 120. For example, the reverse baffle component 120 may be treated with phosphate finish, a nitride finish, or another finish suitable for use with a firearm.

Figure 4:
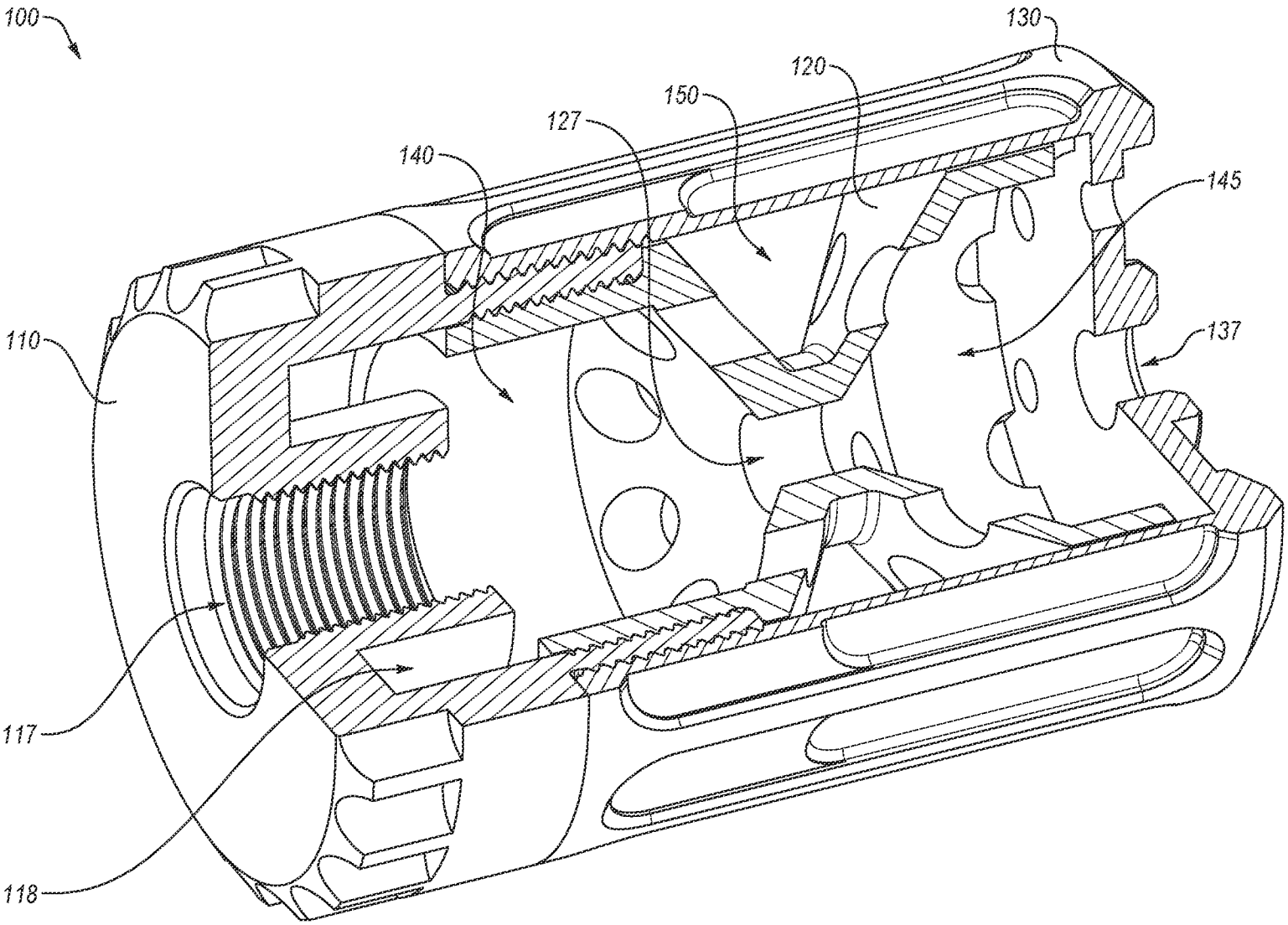
FIG. 4 is a partial cutaway perspective view of an example reverse baffle compensator.

In some embodiments, the reverse baffle component 120 may include the first baffle portion 121 and the second baffle portion 123, and the first baffle portion 121 may include a first sloped portion and the second baffle portion may include a second sloped portion, and the sloped portions may be conical in shape. The two sloped portions may be disposed at least proximate and/or connected to one another. For example, the two sloped portions may be connected, and the two sloped portions may be connected at the narrows ends. The two sloped portions may be directed connected and/or spaced apart. For instance, the sloped portions may be spaced apart by a channel, such as the central channel 127 as shown in FIG. 4. For example, the central channel 127 may be disposed between the narrow end of the first baffle portion 121 and the narrow end of the second baffle portion 123. The wide end of the first baffle portion 121 and the wide end of the second baffle portion 123 may be oriented in opposite directions.

In some embodiments, the first baffle portion 121 and the second baffle portion 123 of the reverse baffle component 120 may include the baffle holes 122, such as the first baffle hole 122*a*, the second baffle hole 122*b*, the third baffle hole 122*c*, etc. The baffle holes 122 may be disposed on the sloped portions of the first baffle portion 121 and/or the second baffle portion 123 of the reverse baffle component 120. In some embodiments, the baffle holes 122 may be uniformly distributed on the sloped portion of the first baffle portion 121 and the sloped portion of the second baffle portion 123. The baffle holes 122 may be disposed about a central channel, such as the central channel 127 as shown in FIG. 4. For example, the baffle holes 122 may be distributed uniformly around the central channel 127, and one or more of the baffle holes 122 may be generally aligned along an axis. For example, one or more of the baffle holes 122 may be generally aligned along an axis that is parallel to a central axis of the reverse baffle compensator 100. In addition, one or more of the baffle holes 122 may be disposed at least proximate the connection of the first baffle portion 121 and the second baffle portion 123. After reviewing this disclosure, one skilled in the art will appreciate that the first baffle portion 121, the baffle holes 122, the second baffle portion 123, and the central channel 127 may have other suitable shapes, sizes, configurations, and/or arrangements.

Alternatively, or additionally, the baffle holes 122 may be arranged such that the baffle holes 122 on the first baffle portion 121 may be symmetric to the baffle holes 122 on the second baffle portion 123, such as mirrored across the channel of the reverse baffle component 120. In such arrangement, the baffle holes 122 may enable improved air flow between the first baffle portion 121 and the second baffle portion 123. Alternatively, or additionally, the baffle holes 122 may be non-aligned between the first baffle portion 121 and the second baffle portion 123. In such arrangement, the baffle holes 122 may hinder air flow between the first baffle portion 121 and the second baffle portion 123.

Although described in connection with three baffle holes 122, the number of baffle holes 122 is illustrative only and should be recognized that various numbers of holes may be used. For instance, the reverse baffle component 120 may include one, two, three, four, five, six, seven, eight, nine, ten, or more baffle holes 122. While the baffle holes 122 shown in the drawings are generally symmetrically disposed and generally the same size, shape, configuration, and arrangement, it will be appreciated that the baffle holes 122 could have any number, size, shape, configuration, and/or arrangement depending, for example, upon the intended use of the reverse baffle compensator 100.

In some embodiments, the baffle threaded portion 126 may be disposed at least proximate an end of the reverse baffle component 120. For example, the baffle threaded portion 126 may be located on the wide end of the first baffle portion 121. In some embodiments, the baffle threaded portion 126 may be configured to couple to the inner threaded portion 114 of the threaded adapter 110. The baffle threaded portion 126 may include a lubricant that may enable a smoother attachment and/or detachment with the inner threaded portion 114 of the threaded adapter 110. Alternatively, or additionally, the baffle threaded portion 126 may include a sealant such that the connection between the baffle threaded portion 126 and the inner threaded portion 114 of the threaded adapter 110 is sealed, such as hermetically sealed.

In some embodiments, the wide end of the second baffle portion 123, which may be opposite the baffle threaded portion 126, may include one or more openings or cutouts, such as the semicircular holes 124. The semicircular holes 124 may be generally uniformly spaced around the edge of the wide end of the second baffle portion 123. In some embodiments, one or more of the semicircular holes 124 may be arranged such that they align with one or more of the holes 134. Alternatively, or additionally, the number of the semicircular holes 124 may be more or less than the number of the holes 134. Alternatively, or additionally, the spacing and/or arrangement between the semicircular holes 124 and the holes 134 may be such that one or more of the semicircular holes 124 may not align with one or more of the holes 134.

In some embodiments, the housing 130 may include one or more of the holes 134, such as the first hole 134*a*, the second hole 134*b*, the third hole 134*c*, etc., and the holes 134 may be disposed towards an end of the housing 130. For example, the holes 134 may be located on an end of the housing 130 that is disposed opposite the end including the housing threaded portion 132. In some embodiments, one or more of the holes 134 may be uniformly distributed about a central channel of the housing 130, such as the housing central channel 137 as shown in FIG. 4. In some embodiments, the holes 134 may be arranged such that air flow may be expelled from the reverse baffle compensator 100 in a direction opposite from the housing threaded portion 132, which direction may be opposite from the operator of the firearm to which the reverse baffle compensator 100 may be attached.

In some embodiments, the housing 130 may be configured to be coupled to the threaded adapter 110. For example, the housing 130 may be similar to the housing 130 shown in FIGS. 1A and 1B. In some embodiments, the housing 130 may include the housing threaded portion 132. In some embodiments, the housing threaded portion 132 may be configured to be coupled to the outer threaded portion 116 of the threaded adapter 110. The housing threaded portion 132 may include a lubricant that may enable a smoother attachment and/or detachment with the outer threaded portion 116 of the threaded adapter 110. Alternatively, or additionally, the housing threaded portion 132 may include a sealant such that the connection between the housing threaded portion 132 and the outer threaded portion 116 of the threaded adapter 110 is sealed, such as hermetically sealed.

Figure 3:
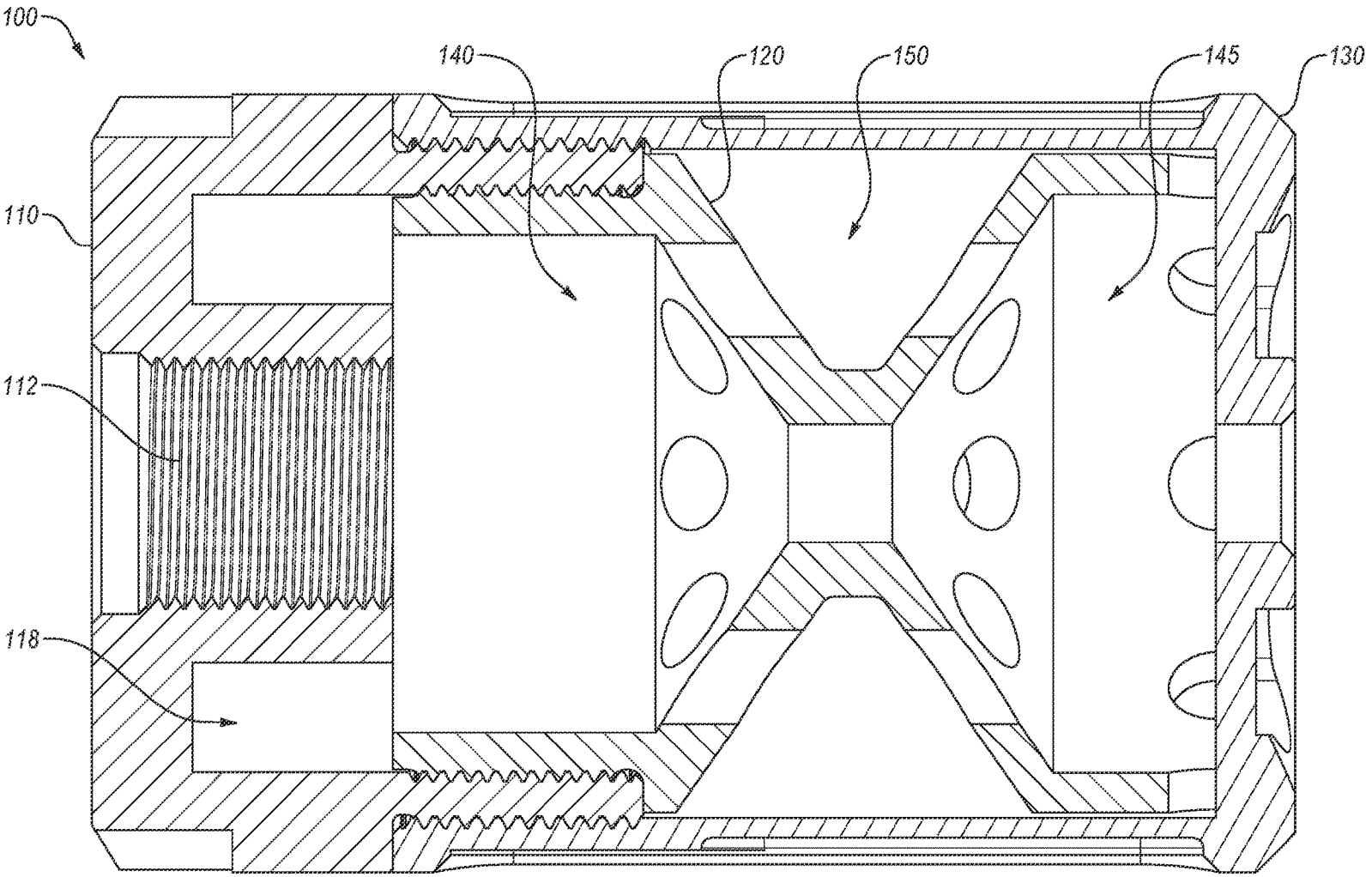
FIG. 3 is a cross-sectional side view of an example reverse baffle compensator.

FIG. 3 illustrates a cross-sectional side view of the reverse baffle compensator 100, in accordance with at least one embodiment described in the present disclosure. FIG. 3 illustrates the threaded adapter 110, the reverse baffle component 120, and the housing 130 all connected using the various threaded components, such as those previously discussed. FIG. 3 illustrates a channel or pathway that the projectile may pass through, and one or more areas, zones, or cavities that may be disposed within the reverse baffle compensator 100. For example, the reverse baffle compensator 100 may include one or more chambers, such as a backfill chamber 118, a first chamber 140, a second chamber 145, and a third chamber 150.

In some embodiments, the channel for the projectile to pass through of the reverse baffle compensator 100 may be disposed down the center of the reverse baffle compensator 100. In some embodiments, the projectile may pass through the middle of the barrel threaded portion 112 of the threaded adapter 110, through the middle of the narrow channel disposed between the two conical portions of the reverse baffle component 120, and through the central opening of the housing 130. The channel for the projectile is further discussed and illustrated relative to FIG. 4.

In some embodiments, at least a portion of the backfill chamber 118 may be formed as part of the threaded adapter 110. The backfill chamber 118 may include a ring or annual-shaped cavity disposed between the barrel threaded portion 112 and the exterior wall of the threaded adapter 110. In some embodiments, the backfill chamber 118 may be connected to the first chamber 140 such that there may be a generally constant fluidity, fluid communication, and/or fluid flow between the backfill chamber 118 and the first chamber 140.

In these and other example embodiments, the first chamber 140 may be at least partially disposed within the cavity of one or more of the portions of the reverse baffle component 120, such as the first baffle portion 121. In some embodiments, the second chamber 145 may be at least partially disposed within the cavity of a portion of the reverse baffle component 120 not associated with the first chamber 140, such as the second baffle portion 123. In some embodiments, the third chamber 150 may be at least partially disposed between the exterior of the sloped portion of the first baffle portion 121, the exterior of the sloped portion of the second baffle portion 123, and the interior of the housing 130.

In some embodiments, the baffle holes 122 may enable air flow or fluid communication between the first chamber 140 and the third chamber 150. Alternatively, or additionally, the baffle holes 122 may enable air flow or fluid communication between the second chamber 145 and the third chamber 150. In these and other embodiments, there may be a constant fluidity and/or fluid communication between the first chamber 140, the second chamber 145, and/or the third chamber 150. The holes, such as the baffle holes 122, and the chambers, such as the chambers 118, 140, 145, and/or 150, may be sized and configured to help control gas flow. For example, the baffle holes 122 and the chambers 118, 140, 145, and/or 150 may be sized and configured to control gas flow when the firearm is fired.

FIG. 4 illustrates a partial cutaway perspective view of the reverse baffle compensator 100, in accordance with at least one embodiment described in the present disclosure. The reverse baffle compensator 100 may include a threaded adapter central channel 117, the central channel 127, and the housing central channel 137. Further, FIG. 4 illustrates the backfill chamber 118 may be connected to and/or in fluid communication with the first chamber 140, the second chamber 145, and/or the third chamber 150.

In some embodiments, the threaded adapter central channel 117 may include a central aperture located in the middle of the barrel threaded portion 112 of the threaded adapter 110. In some embodiments, the central channel 127 may be disposed in a central portion of the reverse baffle component 120, such as the channel connecting the first baffle portion 121 and the second baffle portion 123. In some embodiments, the housing central channel 137 may be disposed centrally on the distal end of the housing 130. In some embodiments, the diameters of the threaded adapter central channel 117, the central channel 127, and/or the housing central channel 137 may be substantially the same. Alternatively, or additionally, the diameter of the threaded adapter central channel 117 may be larger than the diameters of the central channel 127 and/or the housing central channel 137 to accommodate the barrel of the firearm. For example, the diameter of the threaded adapter central channel 117 may be sized to receive the barrel where the diameters of the central channel 127 and the housing central channel 137 are substantially the same as the diameter of the barrel muzzle.

In these and other embodiments, the threaded adapter central channel 117, the central channel 127, and/or the housing central channel 137 may be coaxially aligned. For example, the threaded adapter central channel 117, the central channel 127, and the housing central channel 137 may be arranged and configured to allow passage through each central channel of a projectile fired from a firearm.

Figure 5A:
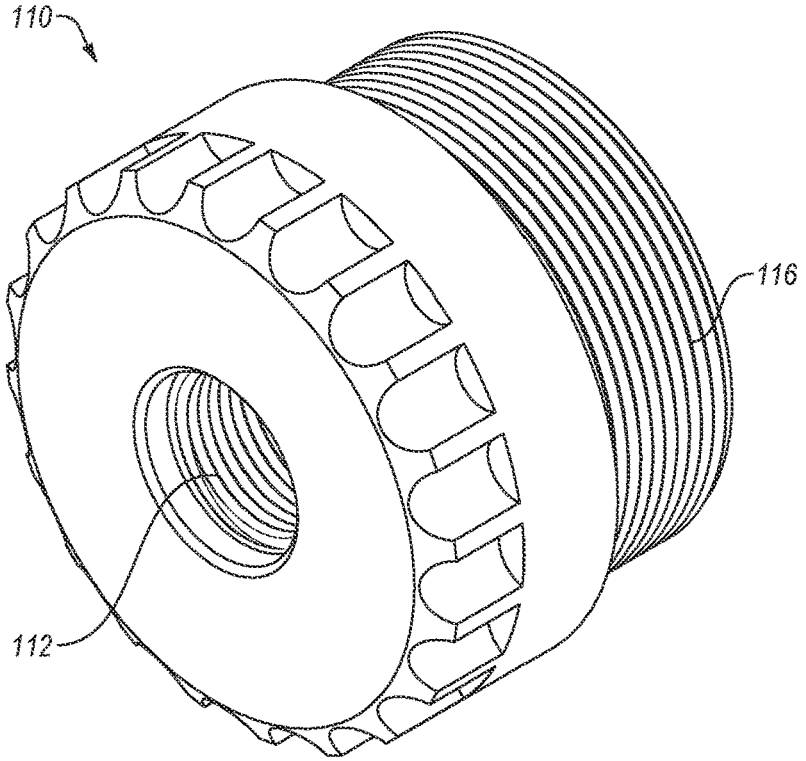
FIG. 5A is a perspective view of an example threaded adapter of an example reverse baffle compensator.
Figure 5B:
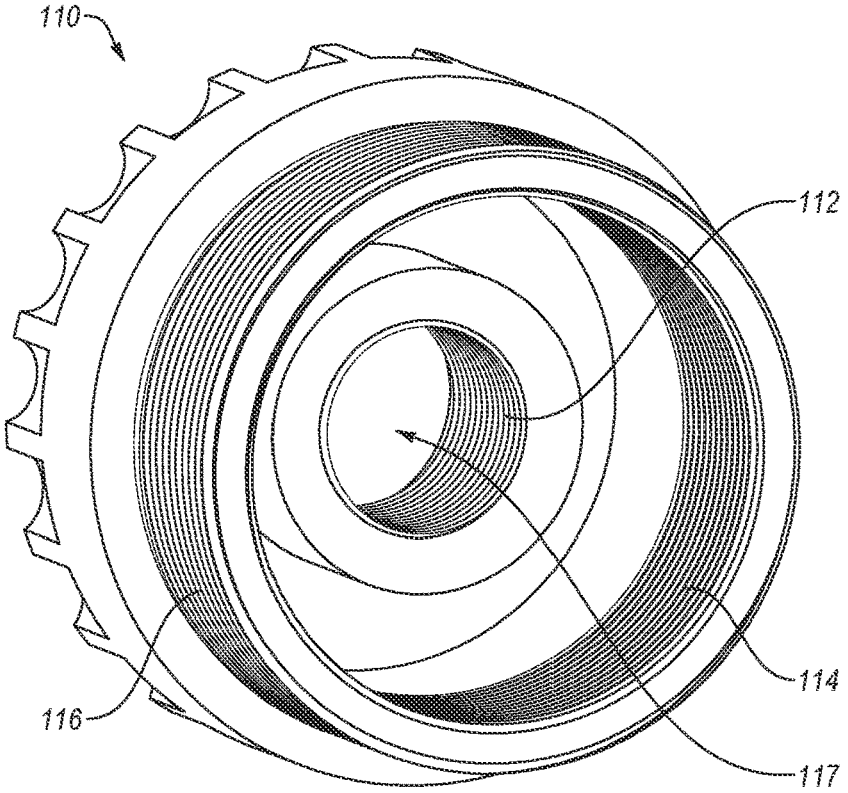
FIG. 5B is another perspective view of an example threaded adapter of an example reverse baffle compensator.

FIGS. 5A and 5B illustrate perspective views of the threaded adapter 110 of the reverse baffle compensator 100, in accordance with at least one example embodiment described in the present disclosure. For example, the threaded adapter 110 shown in FIGS. 5A and 5B may be the same or similar to the threaded adapter 110 shown in FIGS. 2A and 2B.

Figure 6A:
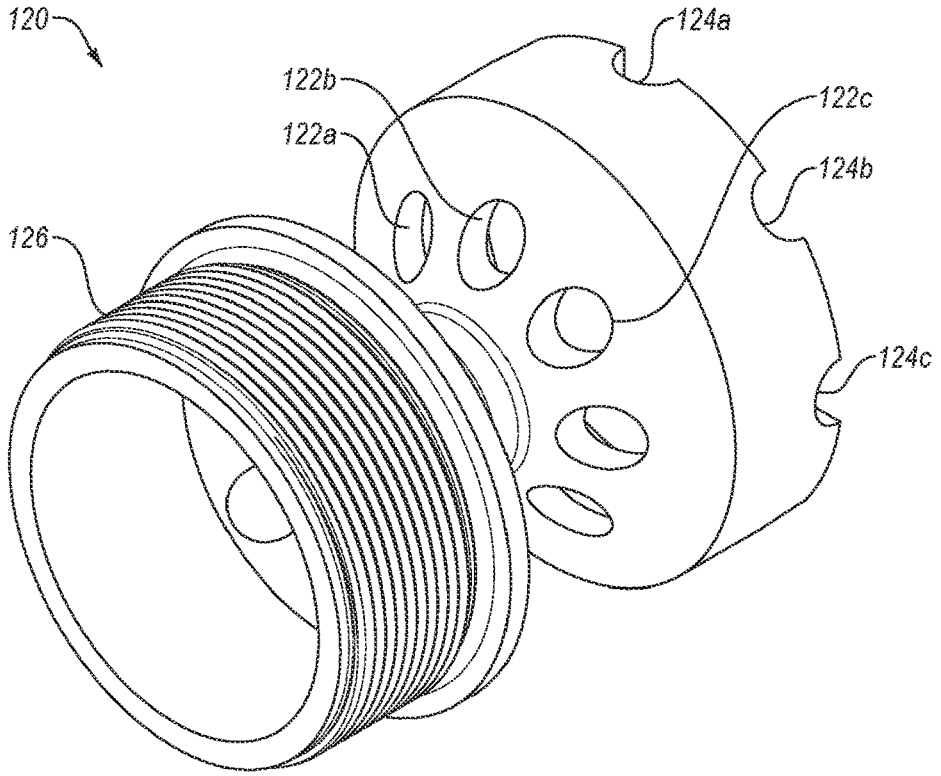
FIG. 6A is a perspective view of an example reverse baffle component of an example reverse baffle compensator.
Figure 6B:
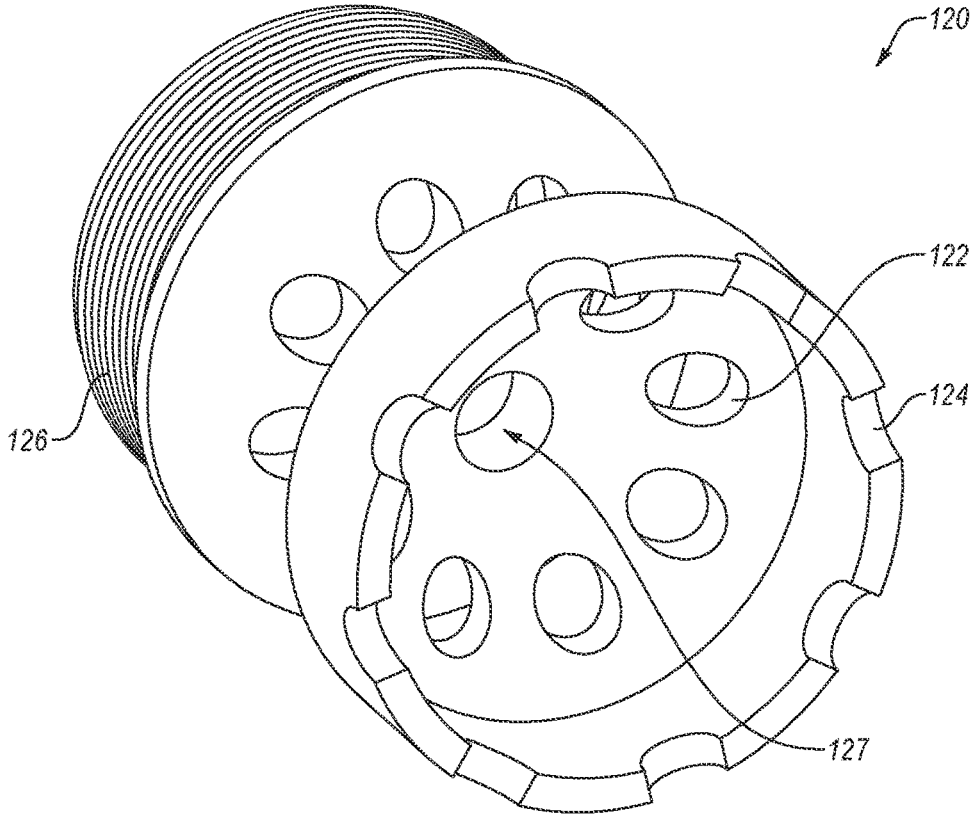
FIG. 6B is another perspective view of an example reverse baffle component of an example reverse baffle compensator.

FIGS. 6A and 6B illustrate perspective views of the reverse baffle component 120 of the reverse baffle compensator 100, in accordance with at least one example embodiment described in the present disclosure. For example, the reverse baffle component 120 shown in FIGS. 5A and 5B may be the same or similar to the reverse baffle component 120 shown in FIGS. 2A and 2B.

Figure 7A:
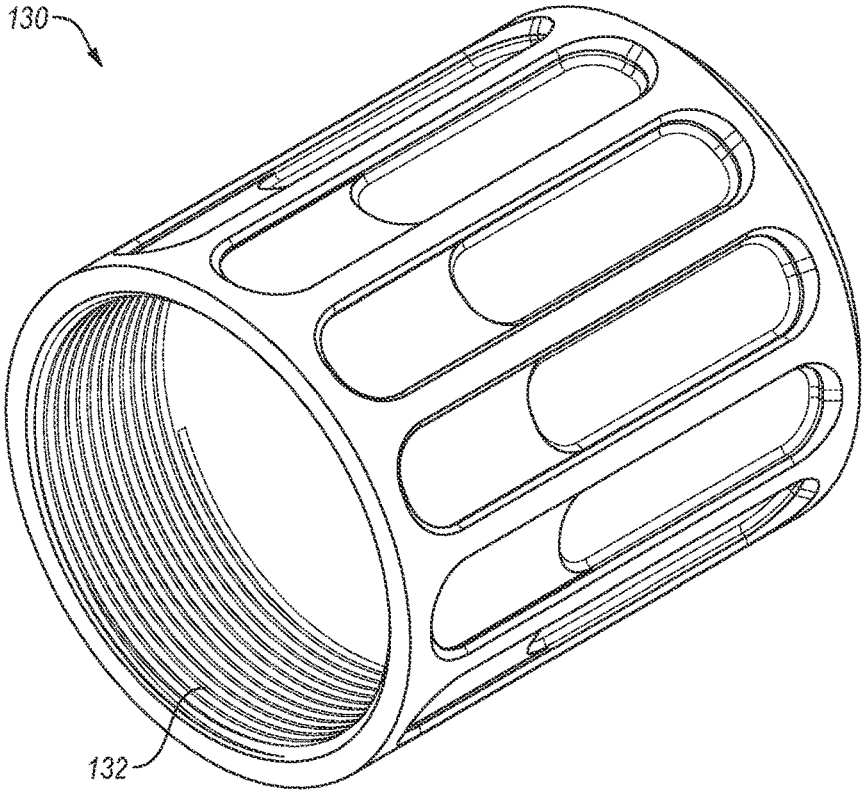
FIG. 7A is a perspective view of an example housing of an example reverse baffle compensator.
Figure 7B:
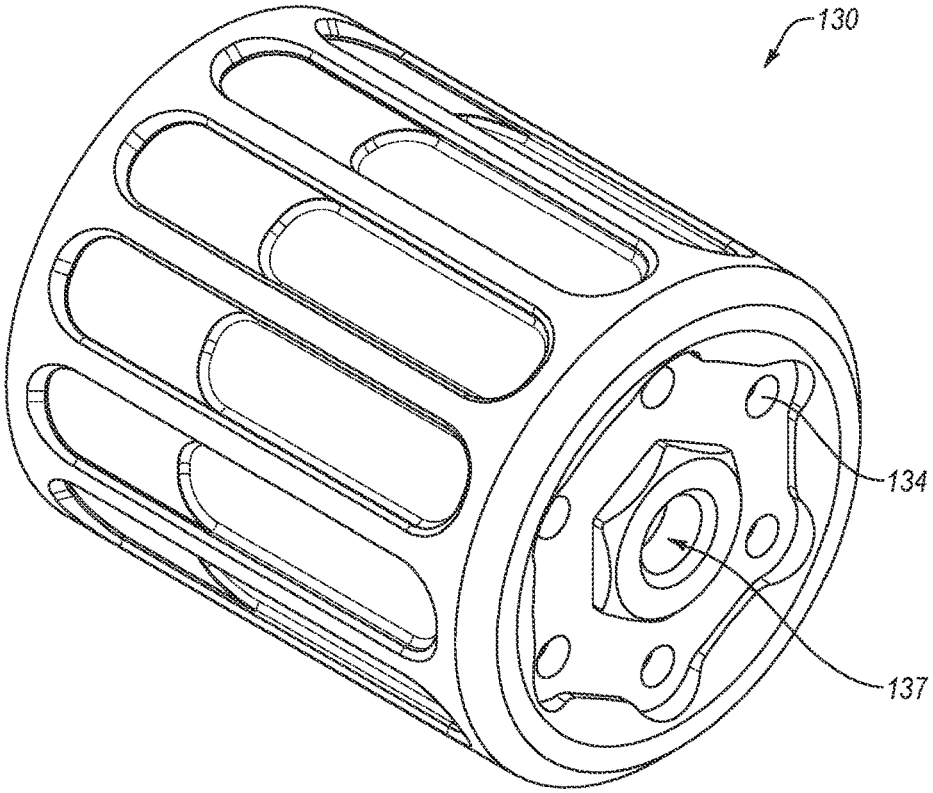
FIG. 7B illustrates another perspective view of an example housing of an example reverse baffle compensator.

FIGS. 7A and 7B illustrate perspective views of the housing 130 of the reverse baffle compensator 100, in accordance with at least one example embodiment described in the present disclosure. For example, the housing 130 shown in FIGS. 5A and 5B may be the same or similar to the housing 130 shown in FIGS. 2A and 2B.

Figure 8:
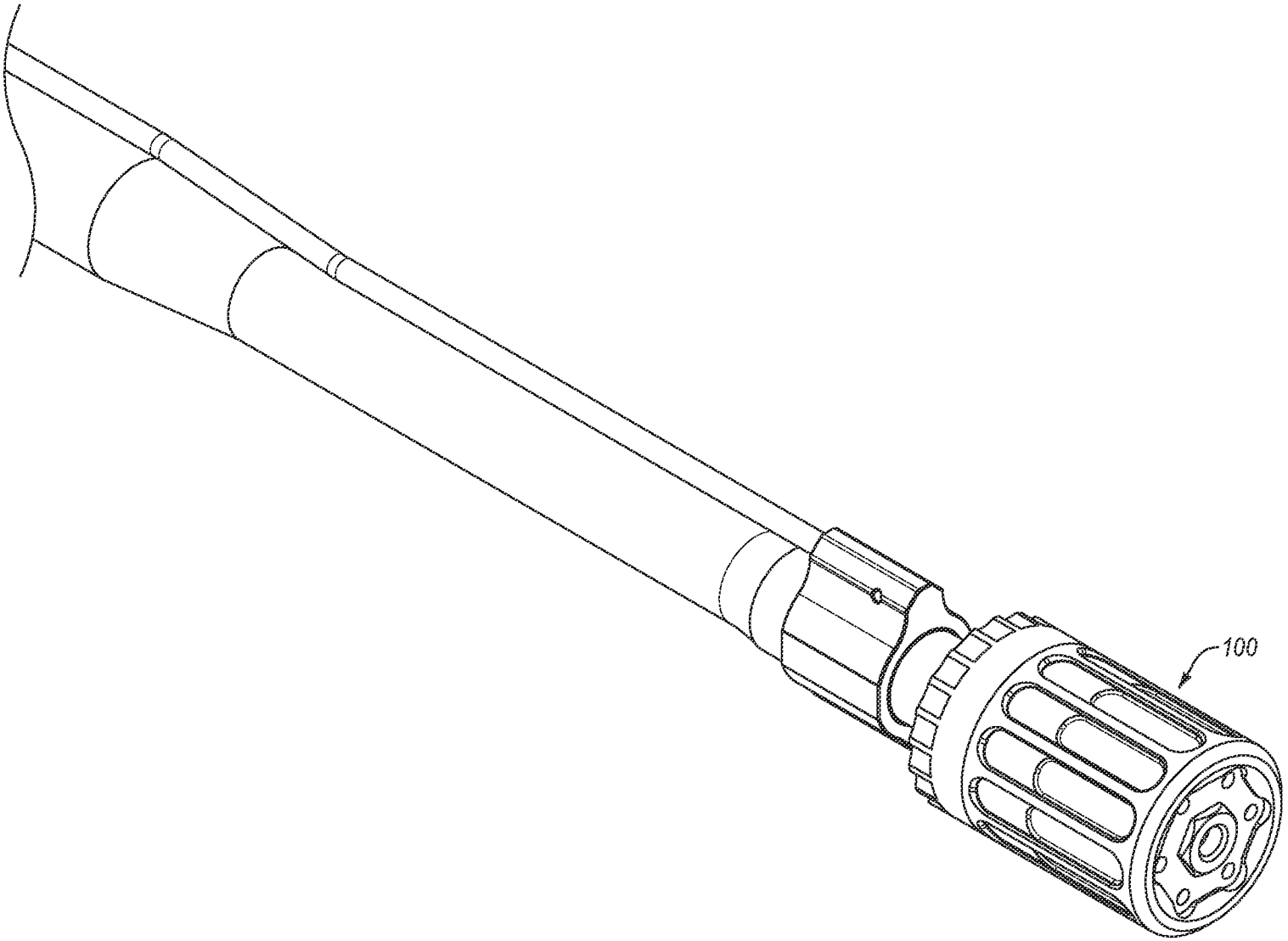
FIG. 8 is a perspective view of an example reverse baffle compensator coupled to an example firearm.

FIG. 8 illustrates a perspective view of the reverse baffle compensator 100 shown in FIG. 1, coupled to an example firearm. Although the reverse baffle compensator 100 is shown attached to a firearm with a long barrel, it should not be limiting to the application of the reverse baffle compensator 100. For example, the reverse baffle compensator 100 may be configured to attach to long or short barrel firearms. Alternatively, or additionally, the reverse baffle compensator 100 may be configured to attach to various calibers of firearm.

FIG. 9 illustrates an exploded, perspective view of components of a reverse baffle compensator, such as the reverse baffle compensator 100, including the threaded adapter 110 and the reverse baffle component 120. Further, FIG. 9 illustrates three different example housings, such as housing 130*a*, housing 130*b*, and housing 130*c*, that may be used in conjunction with the threaded adapter 110 and the reverse baffle component 120 of the reverse baffle compensator, in accordance with at least one example embodiment described in the present disclosure. In some embodiments, the threaded adapter 110 may be coupled to a barrel of a firearm. Additionally, or alternatively, the reverse baffle component 120 may be coupled to the threaded adapter 110. In these and other embodiments, one or more housings, such as the housing 130*a*, 130*b*, and/or 130*c*, may be coupled to the threaded adapter 110, which may encase the reverse baffle component 120. Advantageously, some or all of the portions of the reverse baffle compensator may be used in connection with other devices or structures, such as extensions, silencers, flash suppressors, and the like.

Figure 10:
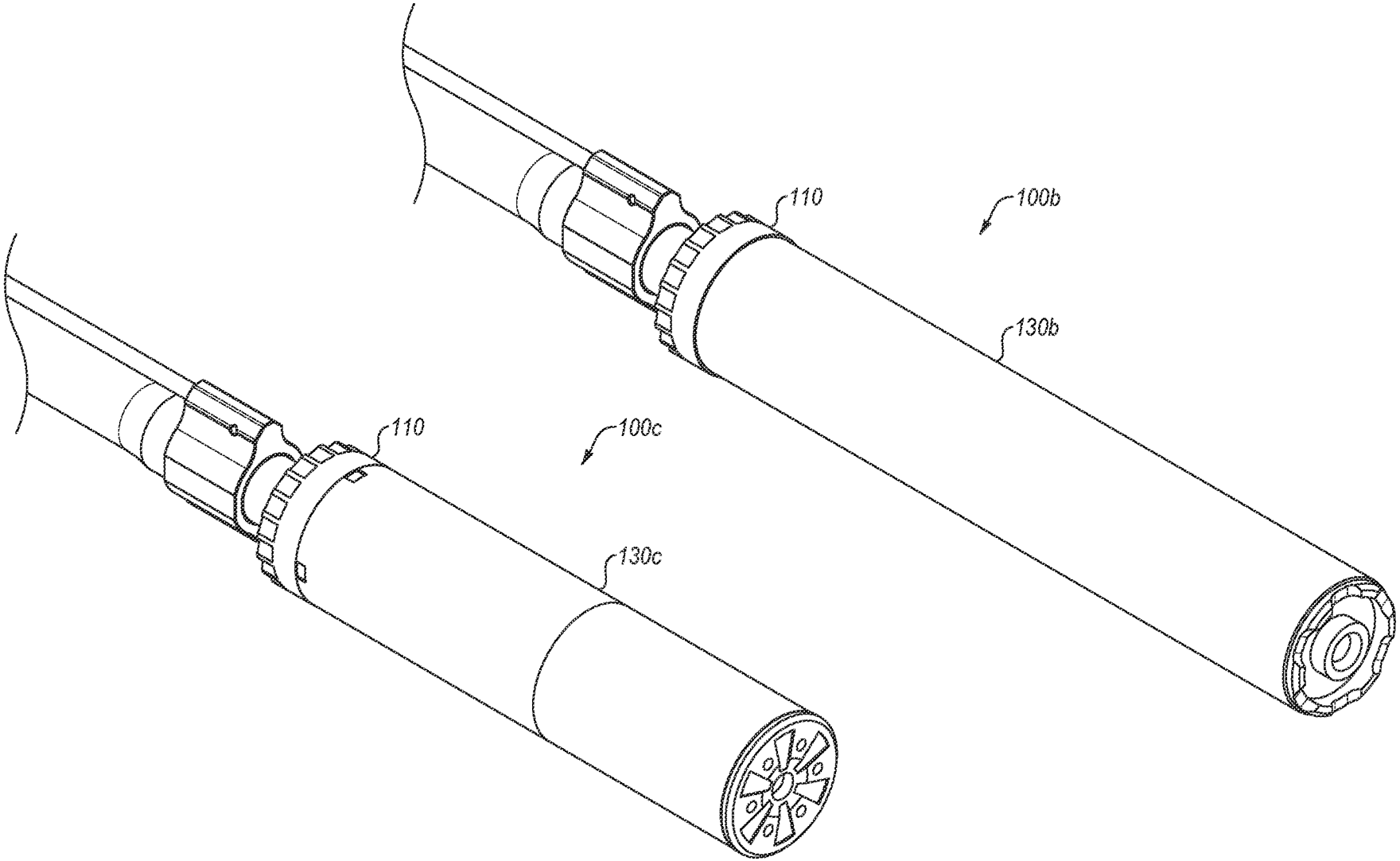
FIG. 10 includes two perspective views of various example housings that may be used with an example reverse baffle compensator, showing the various reverse baffle compensators coupled to example firearms.

FIG. 10 illustrates perspective views of example housing 130*b* and housing 130*c*, which may be part of the reverse baffle compensator 100*b* and 100*c*, showing the various compensators coupled to an example firearm. In some embodiments, the reverse baffle compensator 100*b* may include the threaded adapter 110, the reverse baffle component 120 (not shown in FIG. 10, but shown in FIG. 9), and the housing 130*b*. In some embodiments, the reverse baffle compensator 100*c* may include the threaded adapter 110, the reverse baffle component 120 (not shown in FIG. 10, but shown in FIG. 9), and the housing 130*c*. In these and other embodiments, the threaded adapter 110 and the reverse baffle component 120 may be connected to each other and may be connected to the barrel of a firearm, while the housing may be interchangeable, such as housing 130*b* or housing 130*c*.

After reviewing this disclosure, one skilled in the art will appreciate the reverse baffle compensator 100 and its various components may have various shapes, sizes, configurations, and/or arrangements. Additionally, while the accompanying drawings illustrate various exemplary embodiments of the reverse baffle compensator 100, the reverse baffle compensator 100 may include other parts, components, and the like. Further, the reverse baffle compensator 100 need not include one or more of the disclosed parts, components, and the like. In addition, the various features illustrated in the drawings may be drawn to scale, but not necessarily. Furthermore, the drawings may be simplified for clarity and the drawings may not depict all of the features, components, or the like.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

What is claimed is:

1. A firearm attachment comprising:

a threaded adapter comprising:

a first threaded end including a first threaded portion;

a second threaded end including a second threaded portion, the second threaded portion comprising an inner threaded portion and an outer threaded portion;

a housing configured to couple to the outer threaded portion of the threaded adaptor; and a reverse baffle component configured to couple to the inner threaded portion, comprising:

a first baffle portion comprising:

a first wide end with a first wide diameter;

a first narrow end with a first narrow diameter, the first wide diameter being greater than the first narrow diameter; and a first sloped portion disposed between the first wide end and the first narrow end;

a second baffle portion comprising:

a second wide end with a second wide diameter;

a second narrow end with a second narrow diameter opposite; and a second sloped portion disposed between the second wide end and the second narrow end, the second wide diameter being greater than the second narrow diameter;

a channel connecting the first narrow end and the second narrow end;

a first chamber at least partially comprising an interior space of the first baffle portion;

a second chamber at least partially comprising an interior space of the second baffle portion;

a first set of one or more holes disposed on the first sloped portion; and a second set of one or more holes disposed on the second sloped portion and arranged to be coaxially aligned with the first set of one or more holes.

2. The firearm attachment of claim 1, further comprising a plurality of semicircular holes disposed on the second wide end.

3. The firearm attachment of claim 1, further comprising a third chamber at least partially defined by a space between an exterior surface of the first baffle portion, an exterior surface of the second baffle portion, and an interior surface of the housing.

4. The firearm attachment of claim 1, further comprising a backfill chamber at least partially disposed between the first threaded end and an exterior wall of the threaded adapter.

5. The firearm attachment of claim 4, wherein the first chamber comprises the interior space of the first baffle portion and the backfill chamber.

6. The firearm attachment of claim 1, wherein the reverse baffle component is sized to be encased by the housing when the reverse baffle component is coupled to the inner threaded portion and the housing is coupled to the outer threaded portion.

7. The firearm attachment of claim 1, wherein the first wide diameter and the second wide diameter are substantially equal, and wherein the first narrow diameter and the second narrow diameter are substantially equal.

8. The firearm attachment of claim 1, wherein the threaded adapter includes one or more tactile components configured to improve handling by a user.

9. The firearm attachment of claim 1, wherein the housing includes one or more tactile components configured to improve handling by a user.

10. The firearm attachment of claim 1, wherein the first threaded portion is configured to couple with a barrel of a firearm.

11. The firearm attachment of claim 1, further comprising a threaded adapter central channel, a reverse baffle central channel, and a housing central channel, wherein the threaded adapter central channel, the reverse baffle central channel, and the housing central channel are coaxially aligned and configured to allow passage of a projectile from a firearm.

12. The firearm attachment of claim 11, wherein a diameter of the threaded adapter central channel is greater than a diameter of the reverse baffle central channel.

13. The firearm attachment of claim 1, further comprising a plurality of housing holes disposed on a distal end of the housing.

14. A firearm attachment comprising:

a threaded adapter comprising:

a first threaded portion;

a second threaded portion, the second threaded portion comprising an inner threaded portion and an outer threaded portion;

a housing configured to couple to the outer threaded portion of the threaded adaptor; and a reverse baffle component configured to couple to the inner threaded portion, comprising:

a first baffle portion;

a second baffle portion;

a first chamber at least partially comprising an interior space of the first baffle portion; and a second chamber at least partially comprising an interior space of the second baffle portion.

15. The firearm attachment of claim 14, wherein the first baffle portion comprises a first sloped portion and the second baffle portion comprises a second sloped portion.

16. The firearm attachment of claim 14, further comprising a channel disposed between the first baffle portion and the second baffle portion.

17. The firearm attachment of claim 15, further comprising:

one or more holes disposed in the first sloped portion; and one or more holes disposed in the second sloped portion.

18. The firearm attachment of claim 17, wherein one or more holes in the first sloped portion are coaxially aligned with one or more holes in the second sloped portion.

19. The firearm attachment of claim 17, further comprising a third chamber at least partially disposed between an exterior surface of the first baffle portion, an exterior surface of the second baffle portion, and an interior surface of the housing.

20. The firearm attachment of claim 14, further comprising a backfill chamber at least partially disposed in the threaded adapter.

* * * * *